US011998965B2

(12) United States Patent
Zlotnikov et al.

(10) Patent No.: US 11,998,965 B2
(45) Date of Patent: Jun. 4, 2024

(54) SHRINK RING FOR EXTRUSION DIE, AND EXTRUSION DIE COMPRISING SAME

(71) Applicant: Exco Technologies Limited, Markham (CA)

(72) Inventors: Iouri Zlotnikov, Macomb, MI (US); Christopher Braun, Harrison Township, MI (US); Russell Peterson, New Baltimore, MI (US); Robert Sulisz, Macomb, MI (US); Jason Krause, Marine City, MI (US)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 17/862,550

(22) Filed: Jul. 12, 2022

(65) Prior Publication Data

US 2024/0017313 A1 Jan. 18, 2024

(51) Int. Cl.
*B21C 25/02* (2006.01)
*B21C 25/04* (2006.01)

(52) U.S. Cl.
CPC ..... *B21C 25/02* (2013.01); *B21C 25/04* (2013.01)

(58) Field of Classification Search
CPC ..... B21C 25/02; B21C 25/04
USPC ..... 72/269, 264, 266
See application file for complete search history.

(56) References Cited

U.S. PATENT DOCUMENTS

| | | | | |
|---|---|---|---|---|
| 1,847,365 | A * | 3/1932 | Skinner | B21C 25/00 72/269 |
| 3,908,427 | A * | 9/1975 | Wozniak | B21C 25/04 72/264 |
| 3,948,073 | A * | 4/1976 | Lovell | B21K 21/06 220/DIG. 22 |
| 4,223,548 | A * | 9/1980 | Wagner | B21C 25/00 72/271 |
| 4,249,408 | A | 2/1981 | Lovell | |
| 4,341,106 | A * | 7/1982 | Hackett | B21C 23/14 72/264 |
| 4,703,642 | A | 11/1987 | Wagner | |
| 5,152,163 | A * | 10/1992 | Hawkes | B21C 23/005 72/262 |
| 9,162,267 | B2 * | 10/2015 | Hayashi | B21C 23/085 |
| 2010/0143527 | A1 | 6/2010 | Mathai et al. | |
| 2014/0283577 | A1 | 9/2014 | Hayashi et al. | |
| 2016/0228932 | A1 * | 8/2016 | Hayashi | B21C 25/02 |

FOREIGN PATENT DOCUMENTS

| | | |
|---|---|---|
| CN | 106216420 | * 12/2016 |
| DE | 2506701 | 8/1976 |
| DE | 2949587 | 6/1981 |
| FR | 2329367 | 5/1977 |
| JP | H11-129024 A | 6/1999 |

(Continued)

OTHER PUBLICATIONS

Translation of WO-2010079722 (Year: 2010).*
Office Action issued May 5, 2023 in respect of counterpart German Patent Application No. 102022125432.1.

*Primary Examiner* — Bobby Yeonjin Kim

(57) ABSTRACT

An extrusion die includes: a cylindrical mandrel, the mandrel having a circumferential groove formed therein; a cylindrical die plate, the mandrel and the die plate being coupled together; and a shrink ring disposed in the circumferential groove of the mandrel.

14 Claims, 9 Drawing Sheets

(56) References Cited

FOREIGN PATENT DOCUMENTS

| | | | | |
|---|---|---|---|---|
| JP | 2010-125475 | A | 6/2010 | |
| KR | 102390200 | | 4/2022 | |
| WO | WO-2010079722 | A1 * | 7/2010 | ..... B21C 25/02 |

* cited by examiner

SHRINK RING FOR EXTRUSION DIE, AND EXTRUSION DIE COMPRISING SAME

FIELD OF THE INVENTION

The present invention relates generally to extrusion and in particular, to a shrink ring for an extrusion die and an extrusion die comprising the same.

BACKGROUND OF THE INVENTION

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

The pressure exerted by the extrusion ram can impose significant compressive stress on the extrusion die. Excessive compressive stress can, in turn, cause elastic deformation of the extrusion die during operation, resulting in distortion of the shape of the extruded product that ends up as scrap. Still higher compressive stress can cause plastic deformation of the extrusion die, leading to failure of the die and ultimately resulting in costly downtime of the extrusion press.

Hollow extrusion dies, which are configured to produce an extruded product having a hollow shape, comprise a mandrel coupled to a die plate. The mandrel is generally configured to define interior surfaces of the extruded product, while the die plate is generally configured to define exterior surfaces of the extruded product. In comparison with solid extrusion dies, which have a single piece construction and comprise only a single die aperture for producing an extruded product having a solid shape, hollow extrusion dies are more susceptible to excessive compressive stress during operation due to their more intricate construction.

Measures to reduce compressive stress experienced by hollow extrusion dies during operation are known. For example, U.S. Pat. No. 9,162,267 to Hayashi et al. describes an extrusion die provided with a male die through which a billet is extruded from an upstream side to a downstream side, and which is adapted for forming an inside shape of a hollow material; and a female die for holding the male die and forming an outside shape of the hollow material. The male die is formed of a spider and a holder for holding the spider. The spider is formed of a mandrel and a plurality of bridge parts for supporting the mandrel, and enabling a distal-end outer peripheral surface to engage with a bridge-holding surface. The distal-end outer peripheral surface of each of the bridge parts and the bridge-holding surface of the holder are joined by shrink-fitting.

Improvements are generally desired. It is therefore an object at least to provide a novel shrink ring for an extrusion die and an extrusion die comprising the same.

SUMMARY OF THE INVENTION

It should be appreciated that this summary is provided to introduce a selection of concepts in a simplified form that are further described below in the detailed description. This summary is not intended to be used to limit the scope of the claimed subject matter.

In one aspect, there is provided an extrusion die comprising: a cylindrical mandrel, the mandrel having a circumferential groove formed therein; a cylindrical die plate, the mandrel and the die plate being coupled together; and a shrink ring disposed in the circumferential groove of the mandrel.

The circumferential groove may be formed in a cylindrical surface of the mandrel at a rear face of the mandrel. The shrink ring may have a rear surface that is coplanar with the rear face of the mandrel.

The shrink ring may abut the die plate.

The shrink ring may have an additional circumferential groove formed therein. The die plate may have a circumferential tab formed therein, the circumferential flange engaging the additional circumferential groove of the shrink ring.

The mandrel may have an axial length and the shrink ring has a width, the width being from about 0.15 to about 0.50 times the axial length.

The mandrel may further comprise: at least one port through which at least a portion of a billet is advanced; and a core projecting rearwardly from a rear face of mandrel.

In one embodiment, there is provided a metal extrusion press comprising the extrusion die as described above.

BRIEF DESCRIPTION OF THE DRAWINGS

Embodiments will now be described more fully with reference to the accompanying drawings in which.

DETAILED DESCRIPTION OF THE EMBODIMENTS

Figure 1:
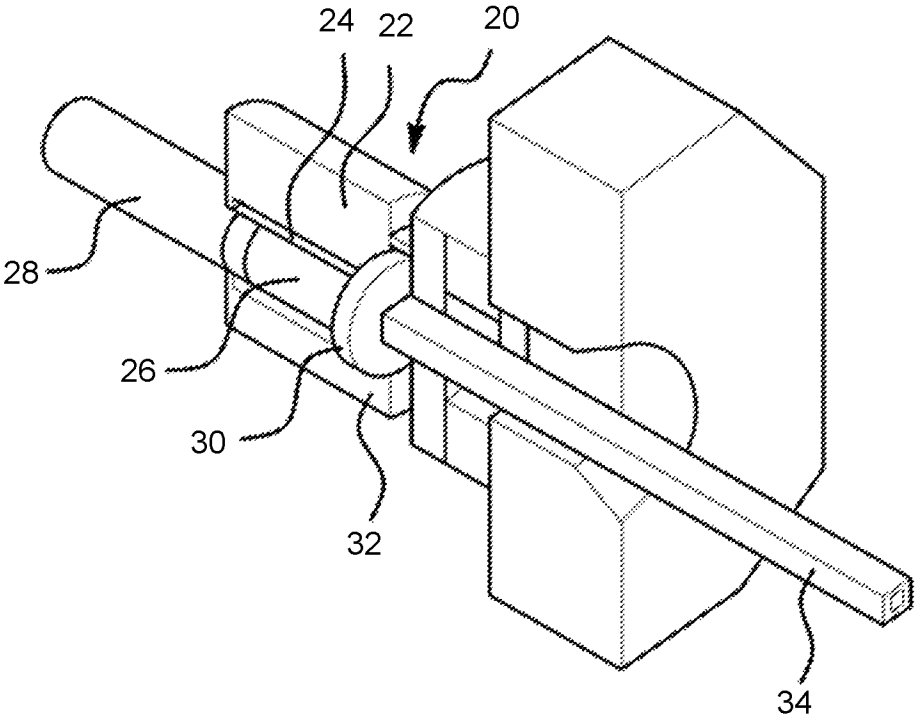
FIG. 1 is a schematic perspective view of a metal extrusion press.
Figure 2:
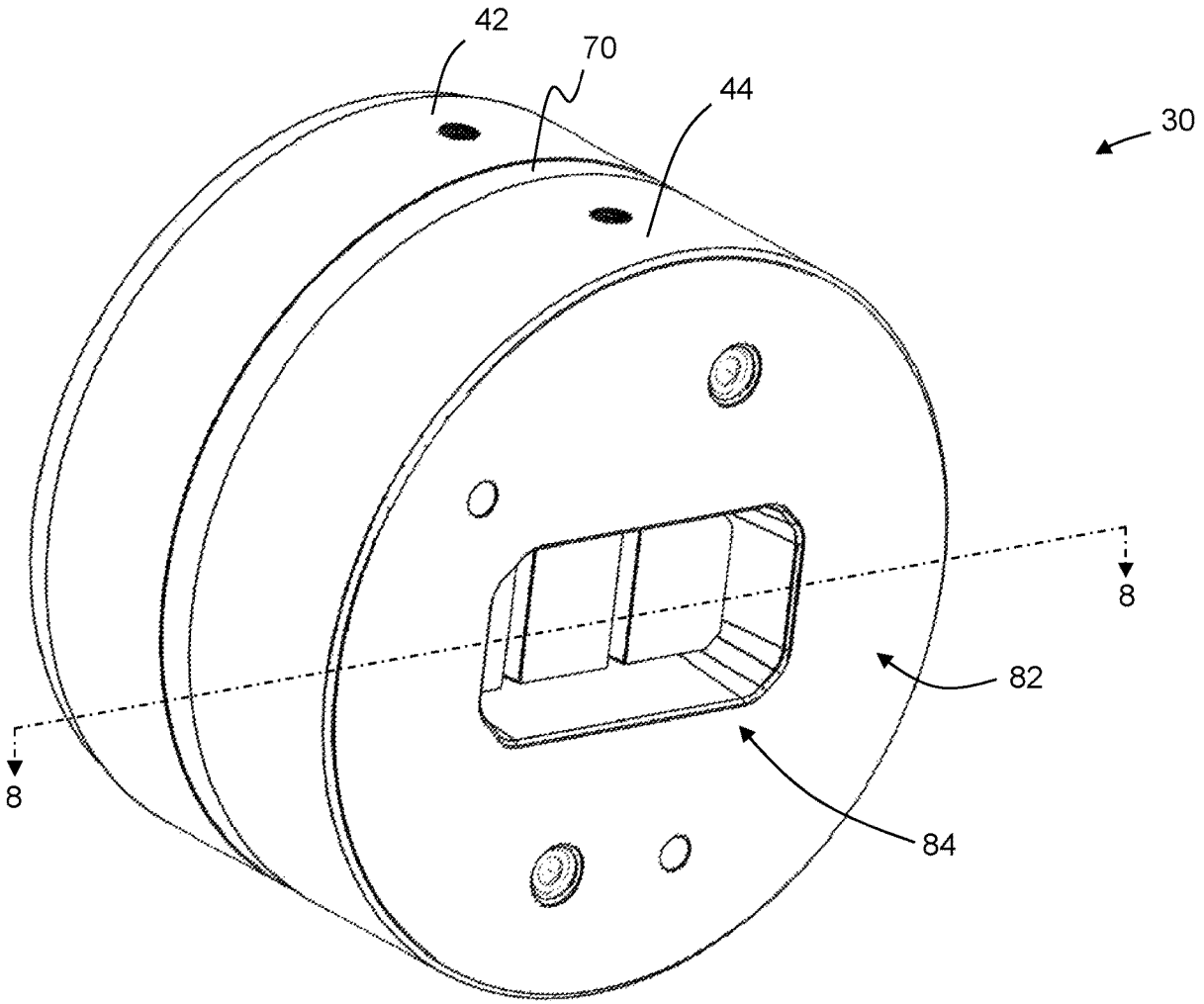
FIG. 2 is a perspective view of an extrusion die forming part of the metal extrusion press of FIG. 1.
Figure 3:
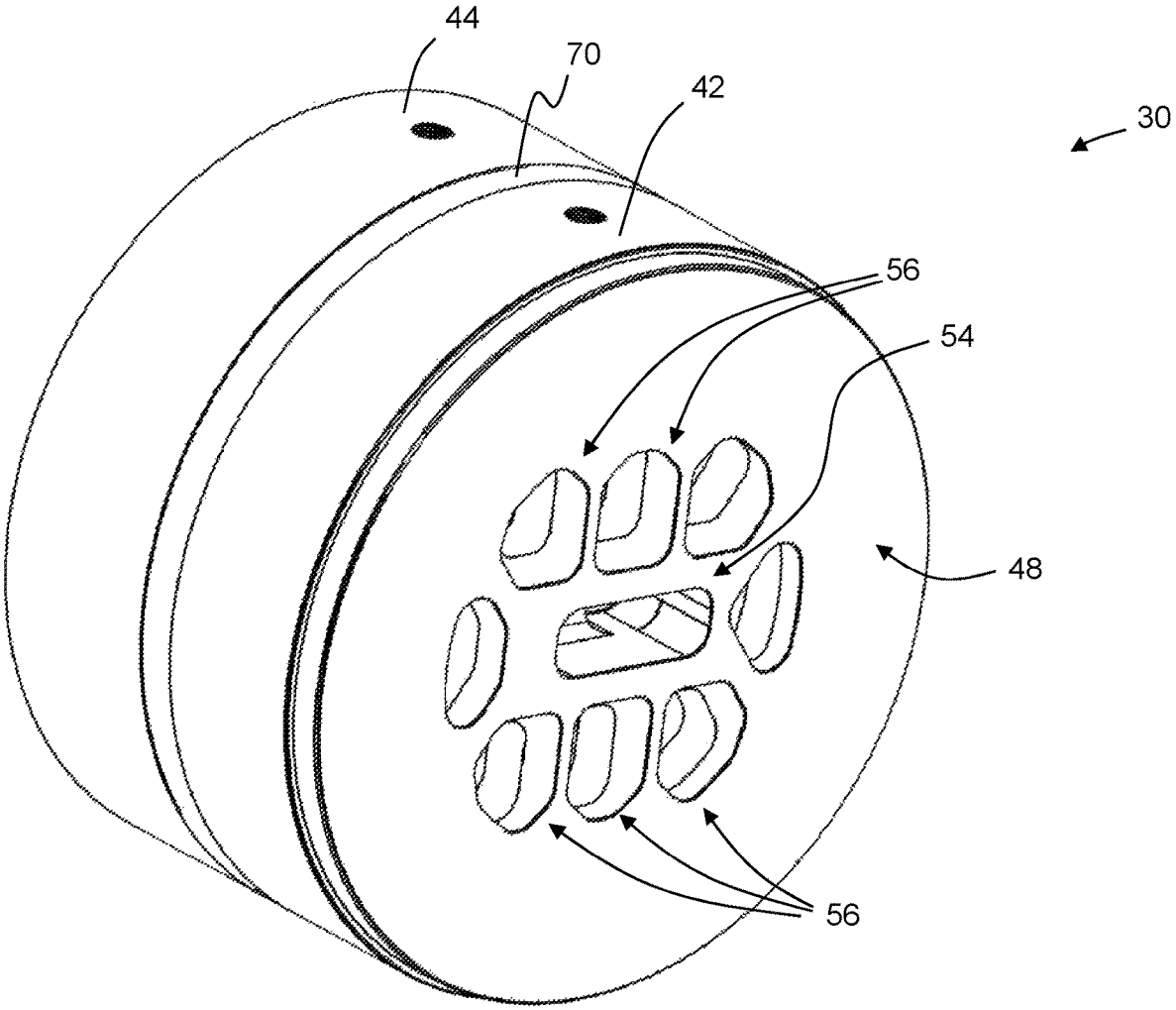
FIG. 3 is another perspective view of the extrusion die of FIG. 2.
Figure 4:
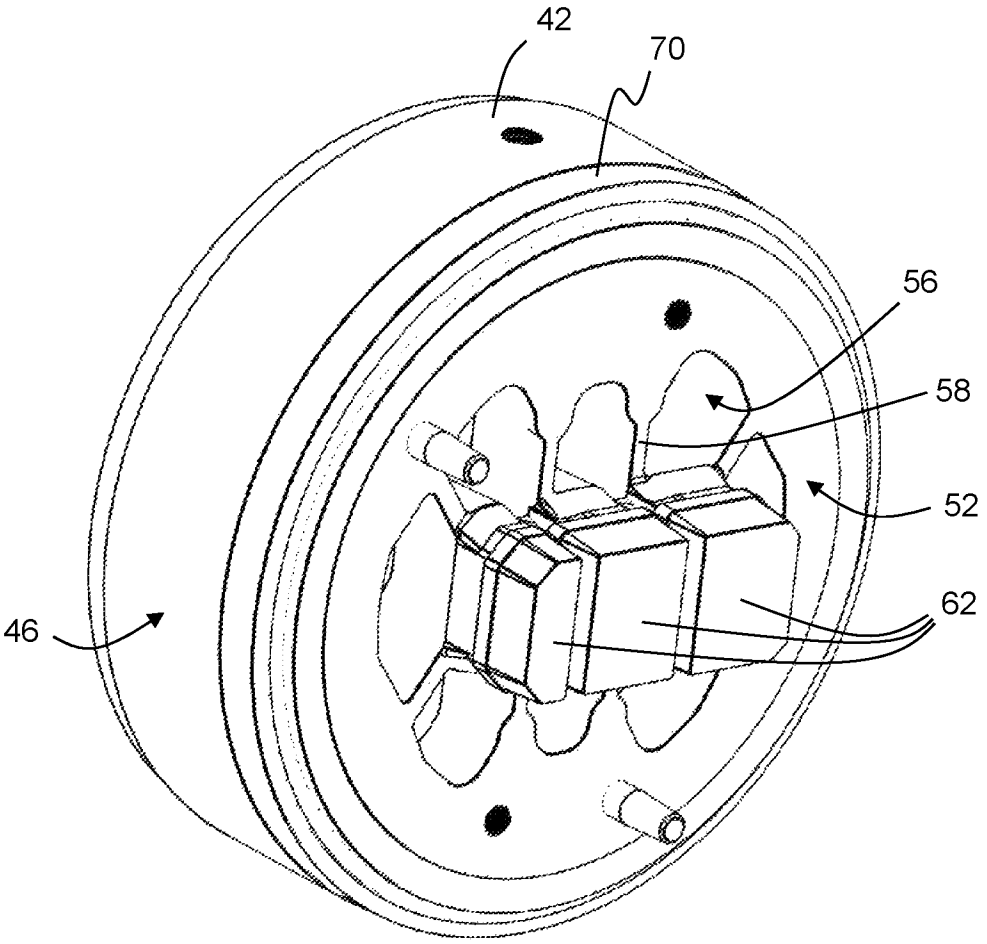
FIG. 4 is a perspective view of a mandrel and a shrink ring forming part of the extrusion die of FIG. 2.
Figure 5:
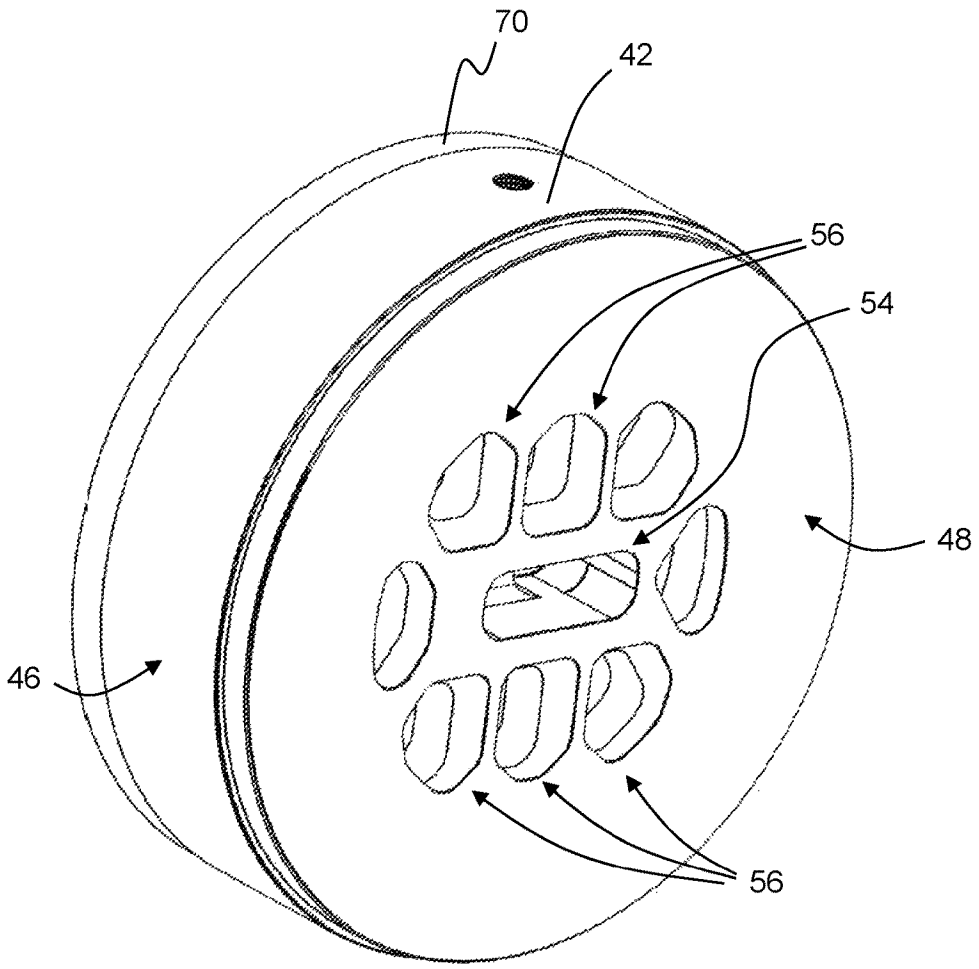
FIG. 5 is another perspective view of the mandrel and the shrink ring of FIG. 4.
Figure 6:
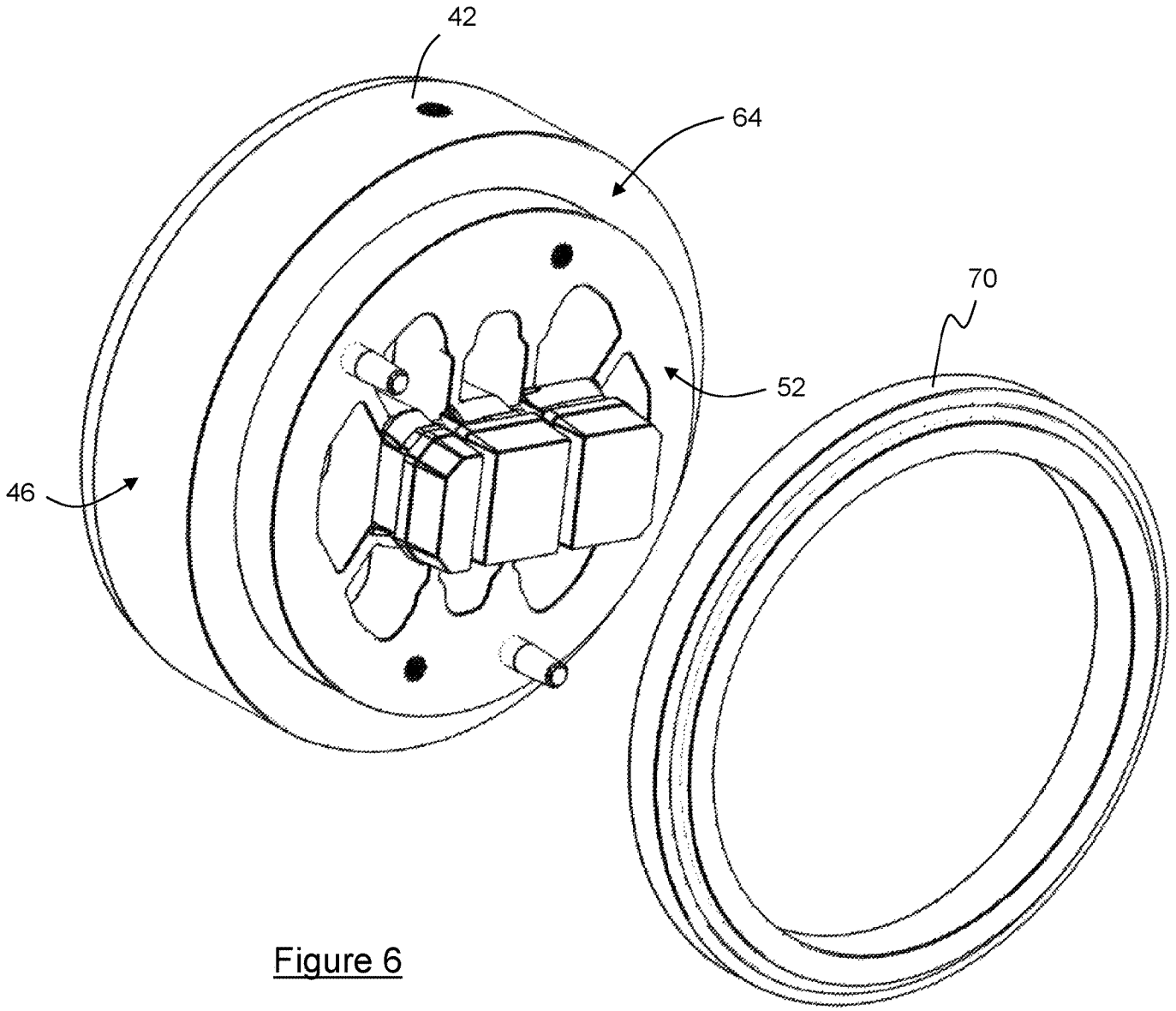
FIG. 6 is an exploded view of the mandrel and the shrink ring of FIG. 4.
Figure 7:
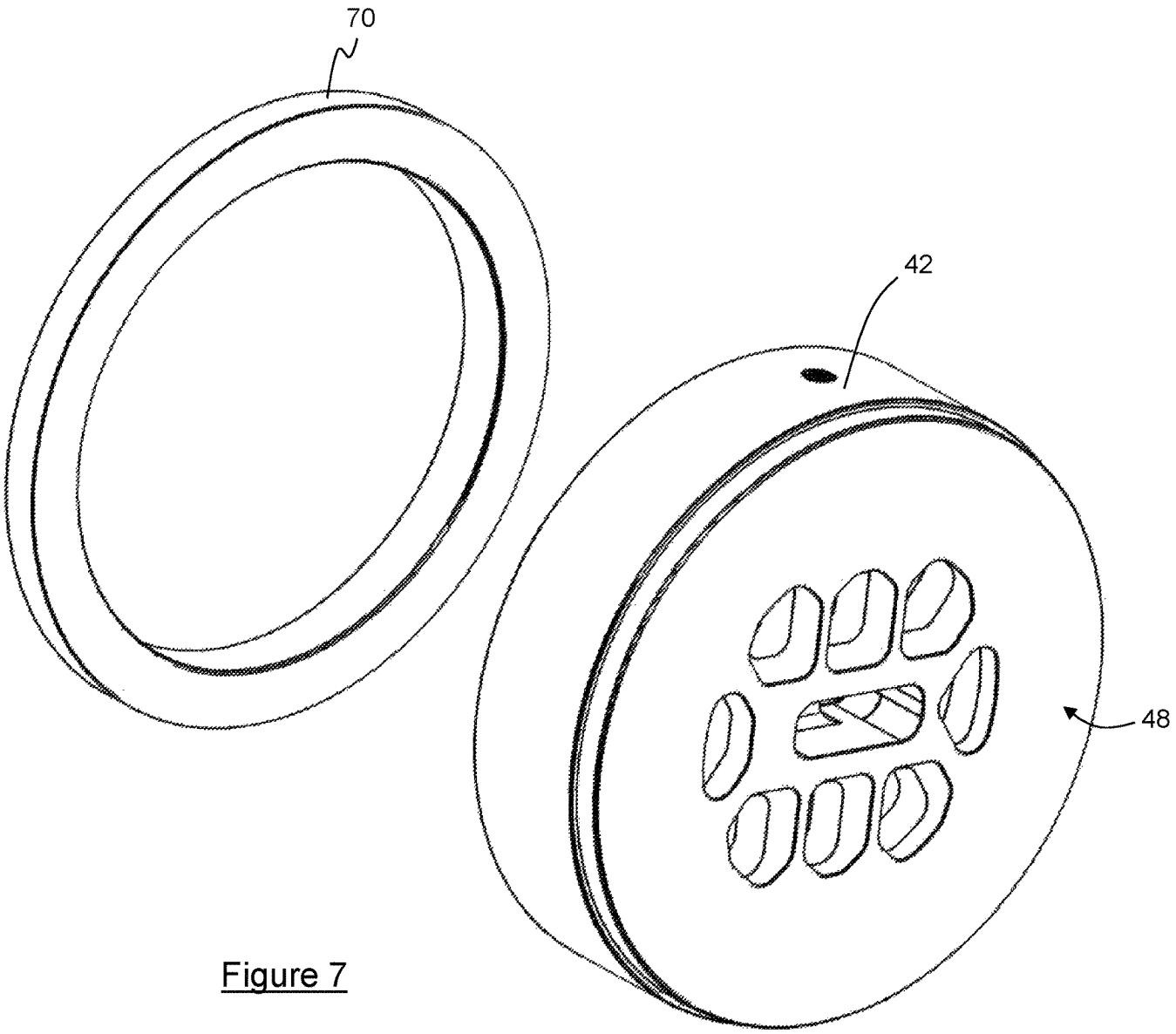
FIG. 7 is an exploded view of the mandrel and the shrink ring of FIG. 5.
Figure 8:
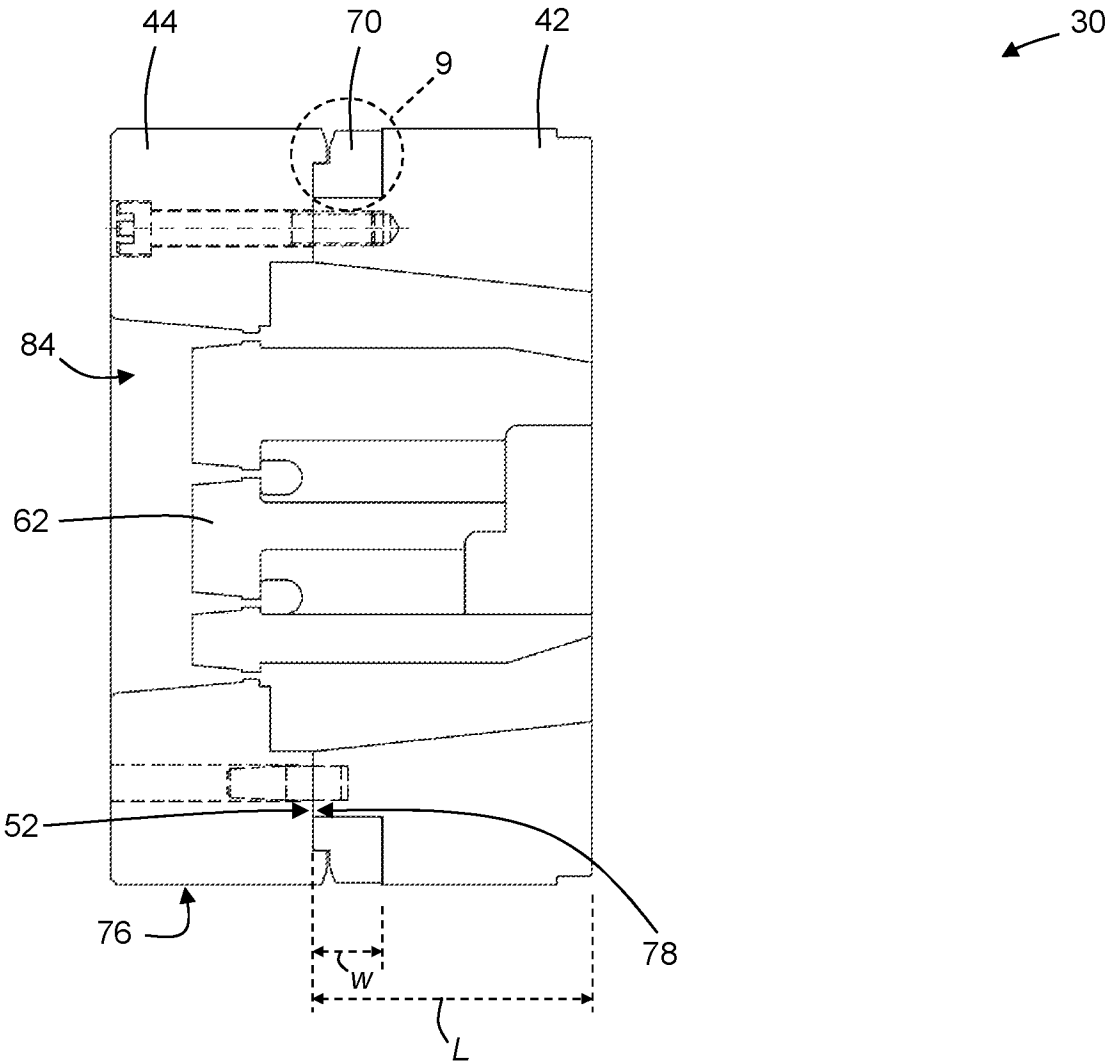
FIG. 8 is a sectional side view of the extrusion die of FIG. 2 taken along the indicated section line.
Figure 9:
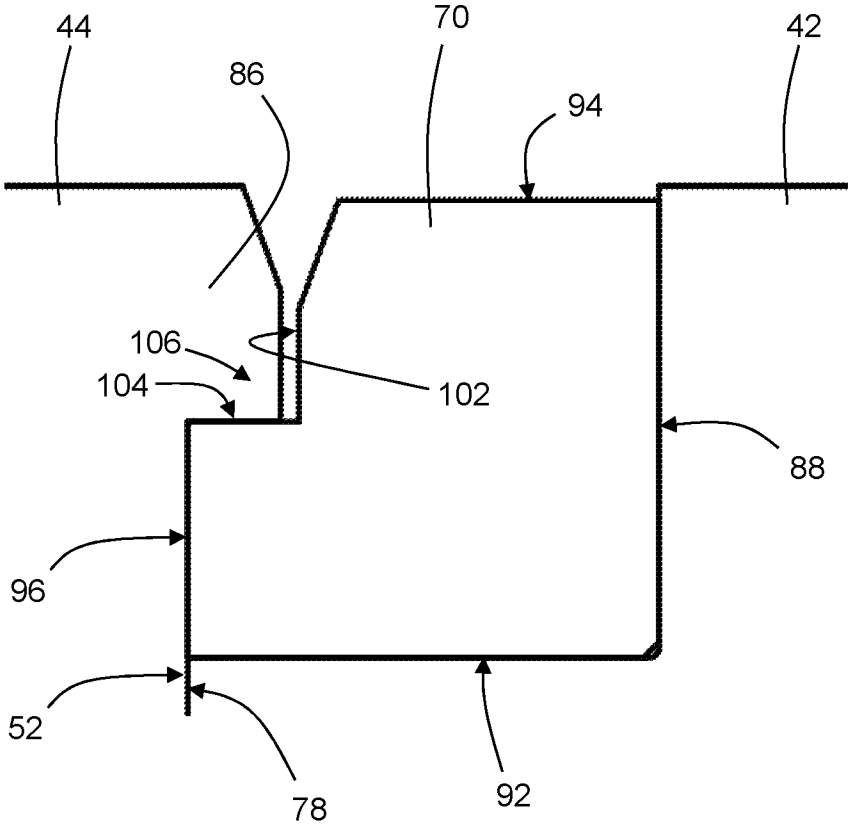
FIG. 9 is an enlarged fragmentary view of the extrusion die of FIG. 8.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the drawings. The spatially relative terms can however, encompass different orientations in use or operation in addition to the orientation depicted in the drawings.

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 abuts a dummy block, which in turn abuts the billet 26 allowing the billet to be advanced through the container 20. An extrusion die 30 is positioned adjacent a die end 32 of the container 20.

During operation, once the billet 26 is heated to a desired extrusion temperature (typically 800-900° F. for aluminum), it is delivered to the extrusion press. The extrusion ram 28 is then actuated to abut the dummy block, thereby to advance the billet 26 into the container and towards the extrusion die 30. Under the pressure exerted by the advancing extrusion ram 28 and dummy block 30, the billet 26 is extruded through the profile provided in the extrusion die 30 until all or most of the billet material is pushed out of the container 20, resulting in the extruded product 34.

The extrusion die 30 may be better seen in FIGS. 2 to 9. The extrusion die 30 is a hollow extrusion die, and is configured to form an extruded product 34 having a hollow shape. The extrusion die 30 comprises a generally cylindrical mandrel 42 coupled to a generally cylindrical die plate 44. As will be understood, the mandrel 42 is generally configured to define interior surfaces of the extruded product 34, while the die plate 44 is generally configured to define exterior surfaces of the extruded product 34.

The mandrel 42 comprises a generally cylindrical body of unitary, single-piece construction that has an outer cylindrical surface 46, a front face 48, and a rear face 52. A plurality of ports are defined in the mandrel 42, and extend from the front face 48 to the rear face 52. In the example shown, the ports include a central port 54 and a plurality of outer ports 56 spaced radially outwardly from the central port 54. The ports 54 and 56 are separated by webs 58. The mandrel 42 further comprises a plurality of cores 62 projecting rearwardly from the rear face 52. In the example shown, the mandrel 42 comprises three (3) cores 62 projecting rearwardly from the rear face 52, with the cores 62 being separated by gaps that are axially aligned with the central port 54. The cylindrical surface 46 has a circumferential groove 64 formed therein that is sized to accommodate a shrink ring 70. The circumferential groove 64 is formed in the rear half of the mandrel 42 and, in the example shown, the circumferential groove 64 is formed at the rear face 52 of the mandrel 42. Also in the example shown, the circumferential groove 64 has a width, w, that is about one quarter the axial length L of the mandrel 42, or w=0.25 L. The mandrel 42 is fabricated of hot worked tool steel, and in this embodiment the mandrel 42 is fabricated of AISI H13 grade steel.

The die plate 44 comprises a generally cylindrical body of unitary, single-piece construction that has an outer cylindrical surface 76, a front face 78, a rear face 82. An exit port 84 is defined in the die plate 44, and extends from the front face 78 to the rear face 82. In the example shown, the exit port 84 is tapered along its length, and gradually widens towards the rear face 82. The exit port 84 is sized to accommodate the cores 62 projecting rearwardly from the rear face 52 of the mandrel 42. The die plate 44 also comprises a circumferential tab 86 extending around the periphery of the front face 78. The circumferential tab 86 is shaped to engage a circumferential groove defined in the shrink ring 70. The die plate 44 is fabricated of hot worked tool steel, and in this embodiment the die plate 44 is fabricated of AISI H13 grade steel.

The shrink ring 70 is coupled to the mandrel 42 by interference fit, and is configured to apply localized compressive stress to only a portion of the mandrel 42, and namely the rear portion of the mandrel 42 proximate to the rearwardly projecting cores 62. As will be understood, by applying localized compressive stress to the rear portion of the mandrel 42 proximate to the rearwardly projecting cores 62, the shrink ring 70 reduces or eliminates elastic deformation at the rear face 52 of the mandrel 42 and the cores 62, specifically, and thereby reduces or eliminates distortion in the shape of the extruded product 34, and in particular the shape of internal surfaces of the extruded product 34. Additionally, and as will be understood, by applying localized compressive stress to the rear portion of the mandrel 42 proximate to the rearwardly projecting cores 62, the shrink ring 70 eliminates plastic deformation at the rear face 52 of the mandrel 42 at the webs 58 and/or cores 62, and thereby prevents cracking failure of the extrusion die 30 that would otherwise result in costly downtime of the extrusion press.

The shrink ring 70 has a generally annular shape, and has a front surface 88 and an inner surface 92, which abut surfaces of the circumferential groove 64 formed in the mandrel 42, an outer surface 94, and a rear surface 96. In the embodiment shown, the shrink ring 70 has a width that is equivalent to the width of the circumferential groove, w, and the rear surface 96 of the shrink ring 70 is coplanar with the rear face 52 of the mandrel 42 and abuts the front face 78 of the die plate 44. Additionally, the shrink ring 70 has a rear-facing groove surface 102 and a radially outward-facing groove surface 104 formed therein, which together define a circumferential groove 106 of the shrink ring 70. The circumferential groove 106 is shaped to receive the circumferential tab 86 of the die plate 42. In this embodiment, the shrink ring 70 is fabricated of the same material as the mandrel 42, and in the example shown the shrink ring 70 is fabricated of AISI H13 grade steel.

During operation, the extrusion ram 28 is actuated to abut the dummy block and advance the billet 26 into the container and towards the extrusion die 30. Under the pressure exerted by the advancing extrusion ram 28, the billet 26 is extruded through the profile provided in the extrusion die 30. The pressure exerted by the advancing extrusion ram 28 compresses a front portion of the extrusion die 30. In particular, the forward pressure creates a state of bending stress within the mandrel 42, and in particular a state of radially inward compression at the front face 48 of the mandrel 42 and a state of radially outward tension at the rear face 52 of the mandrel 42. As will be understood, the shrink ring 70 opposes the radially outward tension at the rear face 52 of the mandrel 42, and thereby reduces or prevents radially outward deformation, as well as axially forward deformation, of the mandrel 42 at the rear face 52, specifically. The extrusion ram 28 continues to advance the billet 26 into the container and towards the extrusion die 30 until all or most of the billet material is pushed out of the container, resulting in the extruded product 34.

As will be appreciated, the shrink ring 70 reduces or prevents deformation of the mandrel 42 at the rear face 52 during operation. As will be understood, deformation of the rear face 52 of the mandrel 42 can include i) elastic deformation of the mandrel 42 at the rear face 52, which would otherwise result in shifting of the positions of the cores 62 and thereby distort the shape of the extruded product, resulting in scrap product; and ii) plastic deformation, which would otherwise result in cracking and breakage of the webs 58 and/or cores 62 at the rear face 52. By reducing or preventing such deformation, the inventors have found that the shrink ring 70 reduces scrap product, and extends the service life of the extrusion die 30 multifold and avoids costly downtime of the extrusion press.

As will be appreciated, the positioning of the shrink ring 70 at the rear face 52 of the mandrel 42 advantageously allows compressive force to be localized in the region of the mandrel where it is needed, namely at the rear face 52 of the mandrel 42. As will be understood, because the front portion of the mandrel 42 is already under compression due to the forward pressure applied by the billet, additional compression is not needed in the front portion of the mandrel. This advantageously allows the width of the shrink ring 70 (namely, the dimension of the shrink ring 70 that extends along the "die axis", or along the axial direction of the extrusion die 30) to be reduced.

As will be appreciated, the use of the same hot worked tool steel to fabricate both the mandrel 42 and the shrink ring 70 ensures that both the mandrel 42 and the shrink ring 70 advantageously exhibit the same coefficient of thermal expansion, and therefore advantageously expand similarly and commensurately when subjected to elevated temperatures during operation.

Although in the embodiment described above, the circumferential groove 64 accommodating the shrink ring 70 has a width w that is about one quarter the axial length L of the mandrel 42, or w=0.25 L, in other embodiments, the width w of the circumferential groove may alternatively be different and anywhere within the range of between w=0.15 L and w=0.50 L.

Although in the embodiment described above, the circumferential groove 64 is formed in the cylindrical surface 46 at the rear face 52 of the mandrel 42, in other embodiments, the circumferential groove may alternatively be formed the cylindrical surface but spaced from the rear face of the mandrel, such that the circumferential groove is in the rear half or in the rearmost third of the mandrel.

Although in the embodiment described above, the mandrel 42, the die plate 44 and the shrink ring 70 are fabricated of fabricated of AISI H13 grade steel, in other embodiments, one or more of the mandrel, the die plate and the shrink ring may alternatively be fabricated of another grade of hot worked tool steel, such as for example DIN 1.2367 grade steel, AISI H11 grade steel, Dievar or of another suitable steel.

Although in the embodiment described above, the shrink ring 70 is fabricated of the same material as the mandrel 42, in other embodiments, the shrink ring and the mandrel may alternatively be fabricated of different materials.

Although embodiments have been described above with reference to the accompanying drawings, those of skill in the art will appreciate that variations and modifications may be made without departing from the scope thereof as defined by the appended claims.

What is claimed is:

1. An extrusion die comprising:

a cylindrical mandrel having a unitary, single-piece construction, the mandrel having a circumferential groove formed therein;

a cylindrical die plate, the mandrel and the die plate being coupled together; and a shrink ring disposed in the circumferential groove of the mandrel, wherein the shrink ring is separate from the cylindrical die plate and is coupled to the mandrel by interference fit, wherein the shrink ring has a radially innermost surface abutting the circumferential groove, wherein the shrink ring has an additional circumferential groove formed therein, and wherein the die plate has a circumferential tab formed therein, the circumferential tab engaging the additional circumferential groove of the shrink ring.

2. The extrusion die of claim 1, wherein the circumferential groove is formed in a cylindrical surface of the mandrel at a rear face of the mandrel.

3. The extrusion die of claim 2, wherein the shrink ring has a rear surface that is coplanar with the rear face of the mandrel.

4. The extrusion die of claim 1, wherein the shrink ring abuts the die plate.

5. The extrusion die of claim 1, wherein the mandrel has an axial length and the shrink ring has a width, the width being from about 0.15 to about 0.50 times the axial length.

6. The extrusion die of claim 1, wherein the mandrel further comprises:

at least one port through which at least a portion of a billet is advanced; and a core projecting rearwardly from a rear face of mandrel.

7. A metal extrusion press comprising the extrusion die of claim 1.

8. An extrusion die comprising:

a cylindrical mandrel, the mandrel having a circumferential groove formed therein, the circumferential groove being formed in a cylindrical surface of the mandrel at a rear face of the mandrel;

a cylindrical die plate, the mandrel and the die plate being coupled together; and a shrink ring separate from the cylindrical die plate and disposed in the circumferential groove of the mandrel, the shrink ring having a radially innermost surface abutting the circumferential groove, wherein the shrink ring has an additional circumferential groove formed therein, wherein the die plate has a circumferential tab formed therein, the circumferential tab engaging the additional circumferential groove of the shrink ring.

9. The extrusion die of claim 8, wherein the shrink ring abuts the die plate.

10. The extrusion die of claim 8, wherein the mandrel has an axial length and the shrink ring has a width, the width being from about 0.15 to about 0.50 times the axial length.

11. The extrusion die of claim 8, wherein the mandrel further comprises:

at least one port through which at least a portion of a billet is advanced; and a core projecting rearwardly from a rear face of mandrel.

12. The extrusion die of claim 8, wherein the shrink ring is coupled to the mandrel by interference fit.

13. A metal extrusion press comprising the extrusion die of claim 8.

14. An extrusion die comprising:

a cylindrical mandrel having a unitary, single-piece construction, the mandrel having a circumferential groove formed therein;

a cylindrical die plate, the mandrel and the die plate being coupled together; and a shrink ring disposed in the circumferential groove of the mandrel, wherein the shrink ring is separate from the cylindrical die plate and is coupled to the mandrel by interference fit, wherein the shrink ring has a radially innermost surface abutting the circumferential groove, wherein the circumferential groove is formed in a cylindrical surface of the mandrel at a rear face of the mandrel, wherein the shrink ring has a rear surface that is coplanar with the rear face of the mandrel, and wherein the shrink ring abuts the die plate.

* * * * *